United States Patent [19]

Crowe

[11] Patent Number: 4,595,337

[45] Date of Patent: Jun. 17, 1986

[54] HUB FOR WIND MACHINES

[76] Inventor: Scott D. Crowe, 45 Jody La., Camarillo, Calif. 93010

[21] Appl. No.: 684,096

[22] Filed: Dec. 20, 1984

[51] Int. Cl.[4] ..... F04D 29/08; F04D 29/36

[52] U.S. Cl. ..... 416/131; 416/102; 416/148

[58] Field of Search ..... 416/131 R, 131 A, 102, 416/11, 148, 19, 100

[56] References Cited

U.S. PATENT DOCUMENTS

| | | | |
|---|---|---|---|
| 1,491,997 | 4/1924 | Messick | 416/131 X |
| 1,786,057 | 12/1930 | Fales | 416/148 X |
| 2,124,369 | 7/1938 | Everts | 416/19 |
| 2,422,558 | 6/1947 | Korff | 416/102 X |
| 2,484,291 | 10/1949 | Hays | 416/102 X |
| 3,302,867 | 2/1967 | Roffy | 230/134 |
| 3,575,530 | 4/1971 | Hall | 416/131 |
| 3,846,042 | 11/1974 | Keene | 416/110 |
| 4,045,147 | 8/1977 | Curp | 416/100 |
| 4,092,084 | 5/1978 | Barltrop | 416/102 |
| 4,131,391 | 12/1978 | Robinson | 416/140 |
| 4,148,594 | 4/1979 | Stafford | 416/214 R |
| 4,201,514 | 5/1980 | Huetter | 416/102 X |
| 4,245,960 | 1/1981 | Matthews | 416/244 R |
| 4,353,681 | 10/1982 | Doman | 416/131 X |
| 4,415,813 | 11/1983 | Carme | 416/148 X |
| 4,449,889 | 5/1984 | Belden | 416/102 X |

FOREIGN PATENT DOCUMENTS

| | | | |
|---|---|---|---|
| 999082 | 1/1952 | France | 416/131 |
| 532535 | 8/1955 | Italy | 416/102 |
| 23258 | 10/1969 | Japan | 416/102 |
| 462037 | 3/1937 | United Kingdom | 416/19 |

*Primary Examiner*—Everette A. Powell, Jr.

*Attorney, Agent, or Firm*—Cahill, Sutton & Thomas

[57] ABSTRACT

A one piece fan blade for a wind machine is sandwiched between a hub and a plate. A rotatable shaft penetrably engages a bore extending through the plate, the fan blade and the hub and is secured thereto by a teeter pin extending through the bore from opposed passageways in the hub. The shaft is centered radially inwardly in the bore of the hub between opposed journals extending radially inwardly into the bore from the opposed passageways to permit tilting of the hub about an axis coincident with the teeter pin to an angle commensurate with the spacing intermediate the shaft and the bore.

7 Claims, 4 Drawing Figures

HUB FOR WIND MACHINES

The present invention relates to wind machines and, more particularly, to a hub assembly for a wind machine.

Wind machines are used in citrus groves and like agricultural areas to prevent settling of cold air under certain climatic conditions. As is well known, cold air is more dense than warmer air and during a temperature drop, the cold air will tend to flow to low spots along the ground. If there is little or no prevailing wind, the pools of cold air will remain stagnant and draw heat from the surroundings. If the temperature of the cold air is low enough, frost damage to the trees and crop will occur.

One way of combating settling of cold air in orchards is that of forceably mixing upper layer warmer air with the cold air adjacent the ground. Such mixing can be brought about by pedestal mounted or otherwise raised wind machines which cause air flow in and through an orchard. Thereby, the wind machines cause circulation of air through the orchard, which circulation draws in warm air and prevents settling of cold air.

The propellers or fan blades of a wind machine are substantial in size and may vary in diameter between 11 to 17 or more feet. Such fan blades are reasonably but not perfectly statically and dynamically balanced. Moreover, the air foil and angle of attack from the hub to the tip of each blade of the fan blade are not aerodynamically perfect. These discrepancies are generally accepted in view of the extraordinary expenses attendant manufacture of fan blades of this size to near perfect balance and aerodynamic parameters.

The imperfections attendant a fan blade create various stresses at the junction between the fan blade and the rotatable shaft to which it is mounted. In example, it has long been known that a teeter structure must be employed in order to permit the fan blade to tilt in an effort to accommodate static, dynamic and aerodynamic imbalances; otherwise, the loads imposed upon the shaft would cause self-destruction or require such massive mounting mechanisms as to be totally economically unfeasible.

One of the problems attendant a fan blade for a wind machine is that of distributing stress loads between the fan blade center and each blade secured to the center. In U.S. Pat. No. 4,148,594 this problem is addressed by employing a plurality of decreasing length splice plates for securing each fan blade to a blade stub extending from the center. Tilting of the hub is accommodated by reducing the diameter of the rotatable shaft inward of the teeter pin and increasing the bore of the hub outward of the teeter pin. U.S. Pat. No. 4,092,084, while directed to a rotor for an autogyro, illustrates structure for altering the angle of attack of the blades dependent upon the tilt angle of the blade assembly. Such change in angle of attack is accommodated by pivotally interconnecting the stubs of the blades with one another and the teetering hub. U.S. Pat. No. 4,131,391 is directed to a hub for a helicopter rotor having coning hinges securing the blades to the hub, which hub is secured to a rotating shaft through a teeter hinge. U.S. Pat. No. 4,245,960 describes the attachment of a sheet metal fan to a hub by bending alternate segements of the hub radially outwardly into engagement with the periphery of the bore of the fan blade. U.S. Pat. No. 3,302,867 is directed to a means for removeably keying a fan blade to a hub intermediate flexible retainers. U.S. Pat. No. 3,846,042 is directed to a wind machine and illustrates a shaft mounted fan blade.

The present invention is directed to a hub assembly for securing a fan blade, which may be one piece or monolithic, to the rotatable shaft of a wind machine. The fan blade is secured intermediate a plate and a hub by bolts or the like extending therethrough. A teeter pin is journaled within the hub to extend diametrically through the hub bore and a commensurate bore in the rotatable shaft. Journals for the teeter pin extend radially inwardly in the hub bore to centrally locate the shaft within the hub bore. The angle through which the fan blade may tilt about an axis coincident with the teeter pin is a function of the radial spacing between the rotatable shaft and the hub bore. The teeter pin is positionally locked to the rotatable shaft through a keying bolt which keying bolt prevents the teeter pin from sliding axially. Seals attendant each journal retains a lubricant intermediate the teeter pin and the journals.

It is therefore a primary object of the present invention to provide apparatus for tiltably mounting a fan blade upon a rotatable shaft.

Another object of the present invention is to provide apparatus for mounting a one piece two blade fan blade upon a rotatable shaft.

Yet another object of the present invention is to provide apparatus for retaining a rotatable shaft axially centered within the hub assembly of a fan blade for a wind machine.

Still another object of the present invention is to provide a constant bore hub assembly for a fan blade of a wind machine tiltably mounted upon a constant diameter shaft.

A further object of the present invention is to provide a teeter pin mounting for securing the hub assembly of a fan blade to a rotatable shaft which permits tilting of the hub assembly about an axis coincident with the teeter pin axis and yet retains the shaft concentric with the bore of the hub at the teeter pin axis.

A yet further object of the present invention is to provide an inexpensive tiltable hub assembly for fan blades of wind machines.

A still further object of the present invention is to provide a simplified hub assembly for fan blades of wind machines which is sealed to reduce the corrosive effects of water upon the moving parts.

These and other objects of the present invention will become apparent to those skilled in the art as the description thereof proceeds.

The present invention may be described with greater specificity and clarity with reference to the following drawings, in which.

Figure 1:
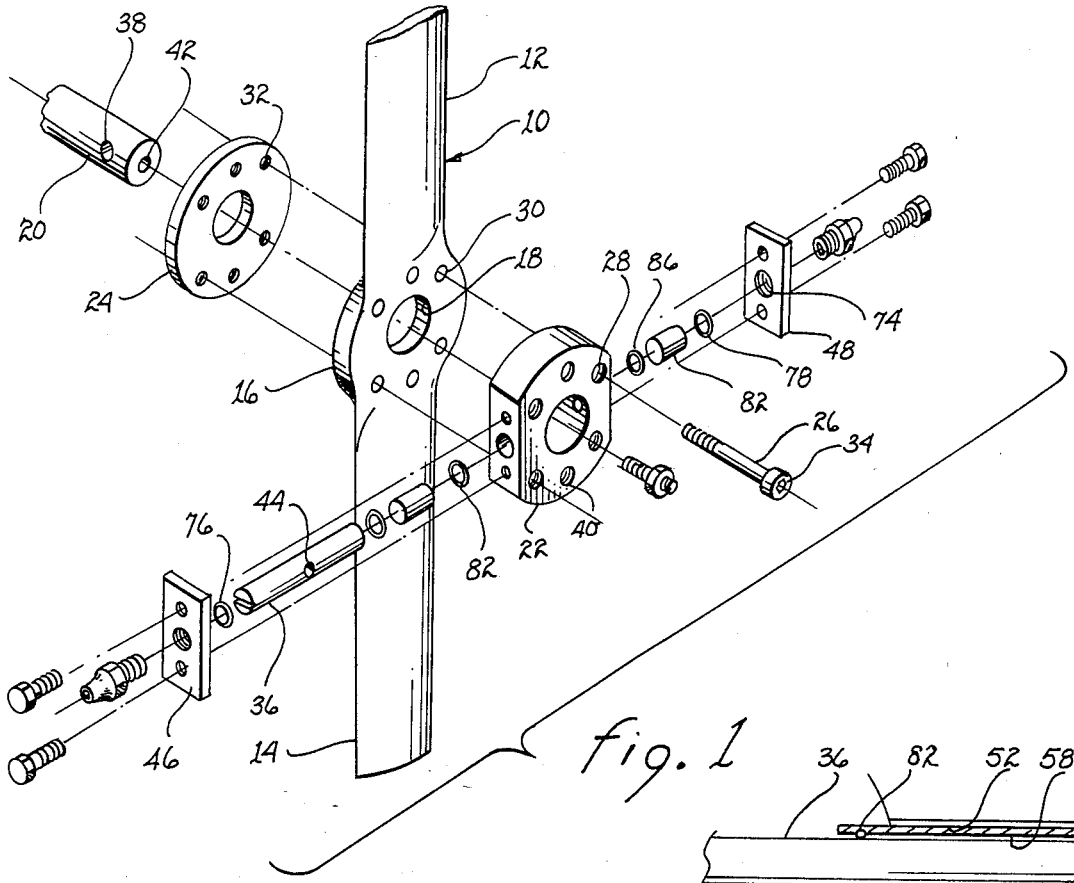
FIG. 1 is an isometric view of the major components of the hub.

Referring to FIG. 1, there is shown a fan blade 10 of a type useable with a wind machine to circulate air in and about an orchard or the like. In the embodiment depicted, the fan blade is constructed as a unitary or monolithic structure having blades 12 and 14 formed as part of and extending in opposed directions from a hub or center section 16. The center section includes aperture 18 for penetrably receiving the end of shaft 20. The shaft is rotatably mounted and driven by suitable motive means to provide rotary motion. Center section 16 is secured intermediate hub 22 and plate 24 of the hub assembly of the present invention by means of bolts 26 extending through the sets of coincident holes 28, 30 and 32 disposed in hub 22, center section 16 and plate 24, respectively. The holes of the sets of holes may be equiangularly located about shaft 20 in the respective components. Bolt 26 may be secured by threaded engagement with plate 24 or by nuts or other retaining means disposed at the rear surface of the plate. Preferably, head 34 of bolt 26 is counter-sunk in hub 22 and the bolt is threadedly engaged with hole 32 to minimize protrusion of elements beyond the hub assembly itself to thereby reduce wind resistance and drag.

The hub assembly is secured to shaft 20 by teeter pin 36 extending through passageway 38 of the shaft and journaled within jub 22. A keying bolt 40 threadedly engages axial passageway 42 in shaft 20 and penetrably engages cavity 44 in the teeter pin to prevent displacement of the teeter pin with respect to the shaft. Retainer plates 46, 48 seal opposed sides of hub 22 to shield the teeter pin and journals therein against the corrosive effects of water and the like.

Figure 4:
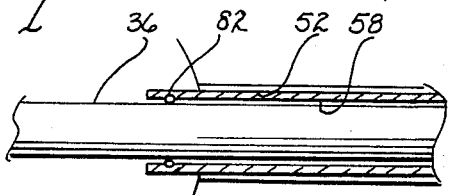
FIG. 4 is a partial detail view illustrating a detail of FIG. 2.
Figure 2:
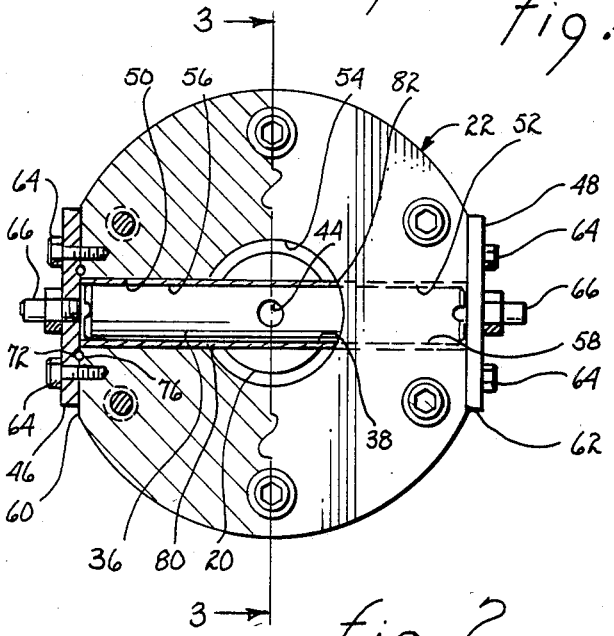
FIG. 2 is a partial cutaway of the hub structure.

Referring jointly to FIGS. 2 and 4, the mounting of teeter pin 36 within hub 22 will be described in detail. A pair of opposed diametrically oriented passageways 50, 52 extend through hub 22 orthogonal to the axis of hub bore 54. Journals 56, 58 are lodged within passageways 50, 52, respectively, for journaling teeter pin 36 therein. Each journal extends from a point coincident with opposed parallel flattened surfaces 60, 62 to a point radially inwardly of bore 54. The extent to which each journal intrudes into the bore is a function of the diametric difference between shaft 20 and bore 54. Radial outward sliding movement of journals 56, 58 is precluded by retainer plates 46, 48. The retainer plates may be secured to hub 22 by means such as bolts 64.

Referring jointly to FIGS. 1, 2 and 4, the means for lubricating teeter pin 36 will be described. A grease fitting 66 is disposed in each of plates 46, 48 to permit introduction of a lubricant into the respective cavities formed by the ends of the teeter pin, journals 56, 58 and retainer plates 46, 48. Grooves 68, 70 may be formed diametrically across the ends of the teeter pin to encourage radial flow of grease when introduced. Journals, 56, 58 may be spirally grooved to encourage flow of grease or lubricant adjacent the teeter pin located therein. Annular grooves 72, 74 are formed in retainer plates 46, 48 radially outwardly of the corresponding passageways. O-rings 76, 78 are disposed in the respective grooves to seal the radially outward ends of the respective passageways. Annular grooves 80, 82 are formed approximate the radially inward ends of journals 56, 58. O-rings 84, 86 are disposed within these grooves to provide a seal between the teeter pin and the respective journal. Accordingly, an essentially closed cavity is developed about each opposing end of the teeter pin to prevent intrusion of water or other corrosive elements and to provide lubrication of the teeter pin.

Figure 3:
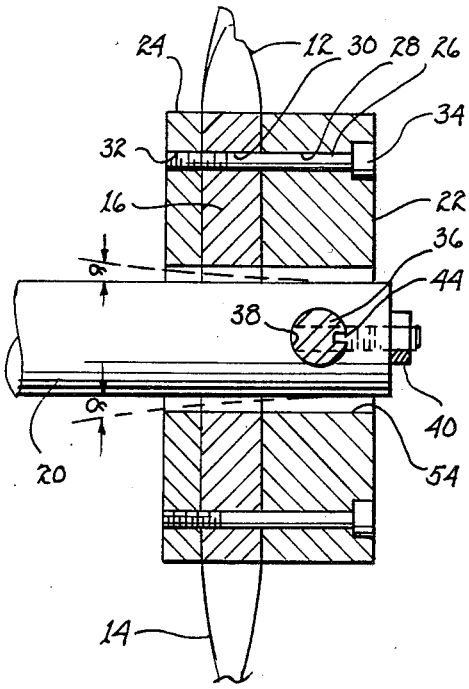
FIG. 3 is a cross-sectional view taken along lines 3—3, as shown in FIG. 2.

Referring primarily to FIG. 3, tilting of fan blade 10 and the hub assembly about shaft will be described. The diameter of shaft 20 is less than that of bore 54 by an amount equivalent to the radial extension of journals 56, 58 into bore 54. Shaft 20 is retained axially centered within bore 54 at teeter pin 36 by the support provided by the teeter pin and the positioning along the teeter pin provided by the journals. As is evident from FIG. 3, pivotal movement of the hub assembly about teeter pin 36 will occur through an angle alpha off center. The total pivotal excursion possible is equivalent to twice angle alpha. Angle alpha is defined by the distance from the longitudinal axis of teeter pin 36 to the rear or front of the hub assembly, depending upon which is the greater distance, and one half of the diametric difference between shaft 20 and bore 54. From this description, it will become evident that fan blade 10 may tilt about shaft 20 during rotation in response to static, dynamic or aerodynamic imbalances attendant the fan blade. Through such tilting, substantial expected stresses are countered without radially loading shaft 20.

It may be readily perceived that installation and removal of fan blade 10 is easily performed for purposes of maintenance or repair. That is, fan blade 10 with hub 22 and plate 24 attached thereto is lifted into penetrable engagement with shaft 20. Teeter pin 36 is inserted within hub 22 to penetrably engage passageway 38. Engaging keying bolt 40 with the teeter pin positionally locks the teeter pin with respect to the shaft. Attachment of retainer plate 46, 8 to set the journals in the bore positionally locates hub 22 and necessarily fan blade 10 concentric with shaft 20. Removal of fan blade 10 may be effected by reversing the above process.

While the principles of the invention have now been made clear in illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. Apparatus for maintaining lubricated a teeter pin supporting a fan blade hub upon a rotatable shaft, said apparatus comprising in combination:

(a) a pair of aligned spaced apart journals diametrically disposed within the hub for receiving opposed ends of the teeter pin;

(b) a pair of plates, one plate of said pair of plates being located at the radial extremity of each journal of said pair of journals for closing the respective end of the respective journal;

(c) means disposed in each plate of said pair of plates for introducing a lubricant into the respective journal of said pair of journals to lubricate in a direction radially inwardly the journaled part of the teeter pin; and (d) seal means disposed proximate the radially inward end of each journal of said pair of journals and adjacent the journaled teeter pin for restraining radially outward flow of foreign matter intermediate the teeter pin and each journal of said pair of journals;

whereby, said pair of plates restrain loss of lubricant due to dynamic forces acting upon the lubricant and said seal means inhibit incursion of foreign matter intermediate the teeter pin and said pair of journals due to dynamic forces.

2. The apparatus as set forth in claim 1 wherein said seal means comprises an annular groove disposed in each journal of said pair of journals.

3. The apparatus as set forth in claim 2 wherein said seal means includes an O-ring in engagement with each said groove.

4. The apparatus as set forth in claim 3 including sealing means disposed intermediate each plate of said pair of plates and the respective journal of said pair of journals for precluding flow of lubricant therebetween in response to the dynamic forces imposed by rotation of the hub.

5. The apparatus as set forth in claim 4 wherein each of said sealing means comprises an O-ring.

6. The apparatus as set forth in claim 1 including sealing means disposed intermediate each plate of said pair of plates and the respective journal of said pair of journals for precluding flow of lubricant therebetween in response to the dynamic forces imposed by rotation of the hub.

7. The apparatus as set forth in claim 6 wherein each of said sealing means comprises an O-ring.

* * * * *